United States Patent [19]

Kubo

[11] Patent Number: 4,708,603

[45] Date of Patent: Nov. 24, 1987

[54] VARIABLE DISPLACEMENT PUMP

[75] Inventor: Chikanari Kubo, Sagamihara, Japan

[73] Assignee: Eishin Technology Company, Ltd., Japan

[21] Appl. No.: 873,955

[22] Filed: Jun. 13, 1986

[51] Int. Cl.[4] ..... F04B 17/00; F04B 35/04

[52] U.S. Cl. ..... 417/415; 417/521; 92/136

[58] Field of Search ..... 417/415, 326, 521; 92/136

[56] References Cited

U.S. PATENT DOCUMENTS

| | | | |
|---|---|---|---|
| 847,394 | 3/1907 | Beck et al. | 417/521 |
| 875,488 | 12/1907 | Bagnulo | 92/136 |
| 1,028,275 | 6/1912 | Purcell | 92/136 |
| 1,250,474 | 12/1917 | Lee | 417/521 |
| 1,275,440 | 8/1918 | Johnson | 417/521 |
| 1,293,853 | 2/1919 | Meigs | 417/521 |
| 2,383,181 | 8/1945 | Enslin et al. | 417/521 |
| 3,612,729 | 10/1971 | Commarmot | 417/415 |
| 3,666,142 | 5/1972 | Gust | 417/415 |
| 3,720,487 | 3/1973 | Wiley | 138/31 |
| 4,509,904 | 4/1985 | MacAskill et al. | 417/568 |
| 4,566,868 | 1/1986 | Menzies | 417/415 |

FOREIGN PATENT DOCUMENTS

| | | | |
|---|---|---|---|
| 705725 | 5/1941 | Fed. Rep. of Germany | 417/521 |
| 2743452 | 3/1978 | Fed. Rep. of Germany | 417/521 |
| 123380 | 9/1980 | Japan | 417/415 |

*Primary Examiner*—Carlton R. Croyle
*Assistant Examiner*—Donald E. Stout
*Attorney, Agent, or Firm*—Andrus, Sceales, Starke & Sawall

[57] ABSTRACT

The present invention provides a variable displacement pump including a cylinder member, a piston member slidably received in said cylinder member, a rack rigidly mounted on one of said members and extending parallel to the longitudinal axis of said one member, a pulse motor having an output shaft, said output shaft including a pinion rigidly connected therewith and engaged by said rack, one of said cylinder and piston members being formed with an opening used in both the suction and discharge of a liquid, and check valves disposed respectively between said opening and an upstream source of liquid and between said opening and a downstream discharging system, whereby the displacement of said pump can be controlled by controlling electric input pulses to said pulse motor.

1 Claim, 3 Drawing Figures

VARIABLE DISPLACEMENT PUMP

BACKGROUND OF THE INVENTION

1. Field of the Invention:

The present invention relates to a variable displacement pump the displacement of which can exactly be controlled even if it is very small.

2. Description of the Prior Art:

In the prior art, it was difficult to maintain a very small amount of pumped fluid at its exact displacement even though a small-sized pump was utilized. Therefore, it was extremely difficult to increase or decrease such very small amount of pumped fluid at a slight rate.

SUMMARY OF THE INVENTION

It is therefore an object of the present invention to provide a variable displacement pump which can exactly control its very small displacement in a numerical manner.

To accomplish the above object, the present invention provides a variable displacement pump comprising a cylinder member, a piston member slidably received in said cylinder member, a rack rigidly mounted on one of said members and extending parallel to the longitudinal axis of said one member, a pulse motor having an output shaft, said output shaft including a pinion rigidly connected therewith and engaged by said rack, one of said cylinder and piston members being formed with an opening used in both the suction and discharge of a liquid, and check valve means disposed respectively between said opening and an upstream source of liquid and between said opening and a downstream discharging system, whereby the output shaft of said pulse motor can angularly be controlled to select the speed of movement in said rack and thus said one member to control the exact displacement of said pump by controlling electric pulses supplied to said pulse motor.

DESCRIPTION OF PREFERRED EMBODIMENT

Figure 2B:
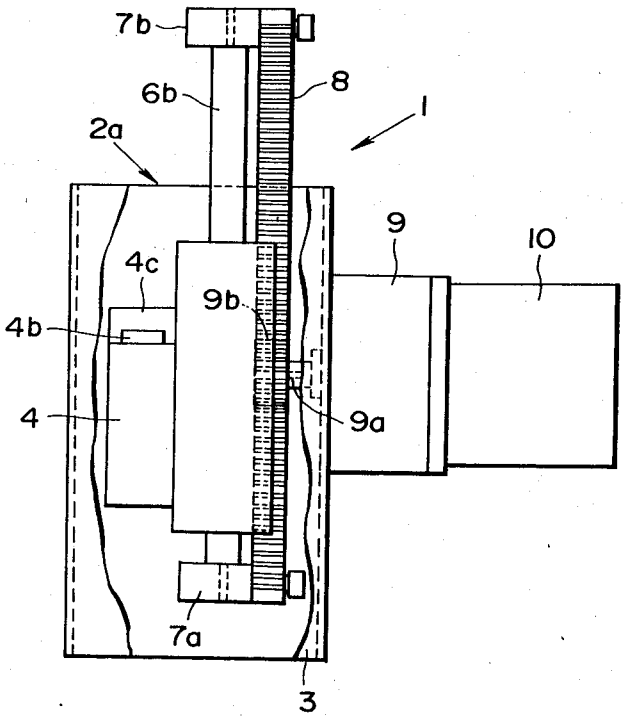
FIG. 2B is a side elevational view, partially broken away, of the variable displacement pump shown in FIG. 2A.
Figure 2A:
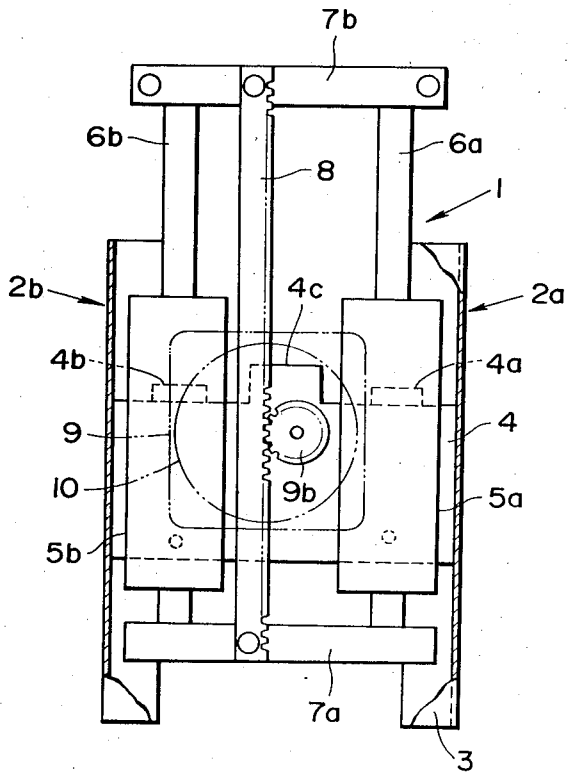
FIG. 2A is a front elevational view, partially broken away, of one embodiment of a variable displacement pump according to the present invention.

Referring now to FIGS. 2A and 2B, there is shown a variable displacement pump 1 constructed in accordance with the present invention, which comprises two discharging systems 2a and 2b having the same displacement. The pump 1 also comprises a casing 3 on which a valve unit 4 is rigidly mounted, the valve unit 4 including check valves (not shown) for the respective discharging systems 2*a* and 2*b*. The valve unit 4 also includes a pair of parallel spaced cylinders 5*a* and 5*b* of the same configuration rigidly mounted thereon. The upper portion of the valve unit 4 is formed with a liquid outlet port 4*a* from the discharging system 2*a*, another liquid outlet port 4*b* from the discharging system 2*b* and a common liquid inlet port 4*c* for both the discharging systems 2*a* and 2*b*.

Pistons (not shown in FIGS. 2A and 2B) are slidably mounted within the cylinders 5*a* and 5*b*, respectively.

Each of the pistons is rigidly connected with a guide rod 6*a* or 6*b* which extends axially through the corresponding cylinder 5*a* or 5*b*. The guide rods 6*a* and 6*b* are connected integrally with each other through connecting members 7*a* and 7*b*. A rack 8 is rigidly mounted at its opposite ends on the connecting members 7*a* and 7*b* and located to extend parallel to the longitudinal axes of the cylinders 5*a* and 5*b*.

On the casing 3 is rigidly mounted a pulse motor 10 having a gear box 9. The output shaft of the pulse motor 10 is drivingly connected with the output shaft 9*a* of the gear box 9 through a gearing (not shown). The output shaft 9*a* of the gear box 9 includes a pinion 9*b* rigidly mounted thereon, which pinion is engaged by the rack 8.

Figure 1:
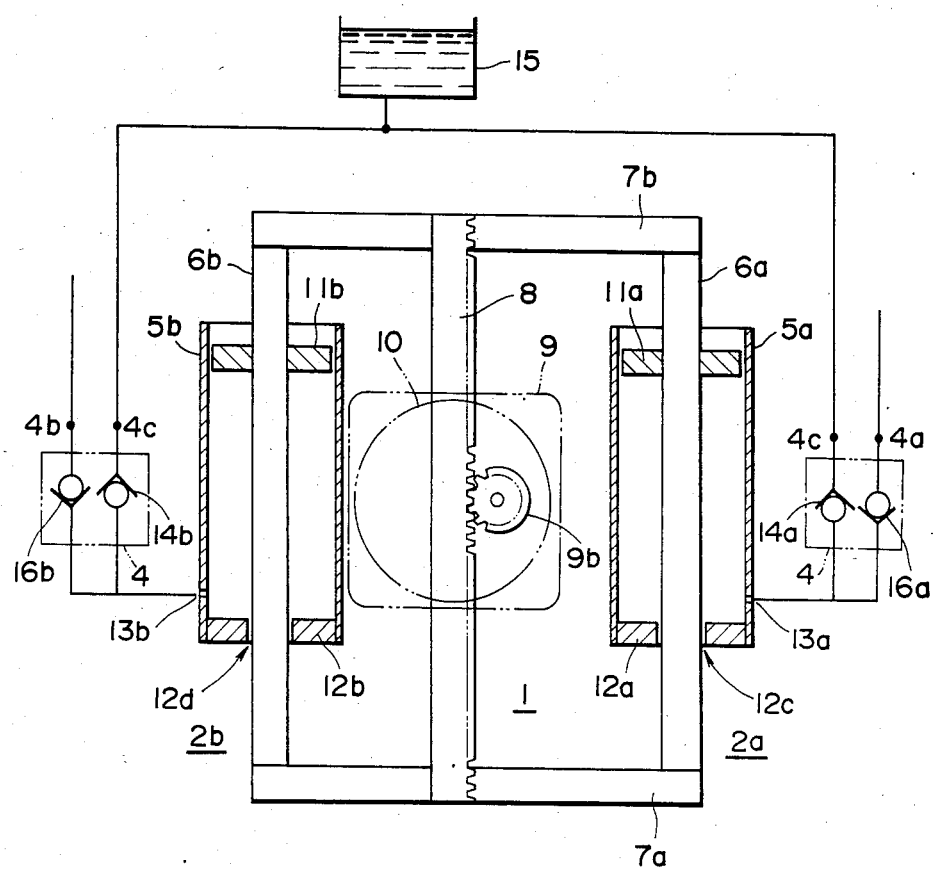
FIG. 1 is a schematic diagram of a system into which a variable displacement pump constructed in accordance with the present invention is incorporated.

Referring next to FIG. 1, the aforementioned pistons are designated 11*a* and 11*b* and shown as rigidly connected with the respective guide rods 6*a* and 6*b* extending through the respective cylinders 5*a* and 5*b*. Each of the cylinders 5*a* or 5*b* is closed by a bottom plate 12*a* or 12*b* formed with a central opening 12*c* or 12*d* through which the corresponding guide rod 6*a* or 6*b* extends. Volume of each cylinder 5*a* or 5*b* defined by its inner wall, the piston and the bottom plate is suitably determined depending on a desired displacement of the pump.

The side wall of each of the cylinders 5*a* or 5*b* is formed with a port 13*a* or 13*b* which is used to effect both the suction and discharge of a liquid to be pumped. The port 13*a* or 13*b* is respectively connected with a valve unit 4 including check valves 14*a*, 16*a* or 14*b*, 16*b*. More particularly, each port 13*a* or 13*b* is in fluid communication with a source of liquid (for example, a liquid tank) 15 through the corresponding check valve 14*a* or 14*b*, so that the flow of liquid will be directed from the liquid tank 15 only toward the corresponding cylinder 5*a* or 5*b* through the corresponding port 13*a* or 13*b*. Each port 13*a* or 13*b* is also connected with the corresponding downstream discharging system through the corresponding check valve 16*a* or 16*b*. Thus, the liquid from the cylinder 5*a* or 5*b* will be directed only toward the corresponding downstream system through the corresponding port 13*a* or 13*b*.

On operation, the pulse motor 10 is first energized by electric pulses to rotate clockwise as viewed in FIG. 1. The rotation of the pulse motor 10 is transmitted to the pinion 9*b* through the output shaft 9*a* of the gear box 9 and then converted into the linear upward movement of the guide rods 6*a* and 6*b* through the connecting members 7*a* and 7*b* under the engagement of the pinion 9*b* with the rack 8. Therefore, the pistons 11*a* and 11*b* are respectively moved upwardly apart from the bottom plates 12*a* and 12*b* within the respective cylinders 5*a* and 5*b*. As a result, the liquid is supplied from the liquid tank 15 to the interior of the cylinder 5*a* through the liquid inlet port 4*c*, the check valve 14*a* and the port 13*a* under a negative pressure produced in that cylinder 5*a*. At the same time, the liquid is similarly sucked from the liquid tank 15 to the other cylinder 5*b*through the liquid inlet port 4*c*, the check valve 14*b* and the port 13*b*.

Subsequently, the pulse motor 10 is energized to rotate counter-clockwise as viewed in FIG. 1 by other electric pulses different from the electric pulses used to energize the same pulse motor clockwise. The counter-clockwise rotation of the pulse motor 10 is similarly transmitted to the pinion 9*b* through the output shaft 9*a* of the gear box 9 and then converted into the linear downward movement of the guide rods 6*a* and 6*b* through the connecting members 7*a* and 7*b* under the engagement of the pinion 9*b* with the rack 8. Thus, the pistons 11*a* and 11*b* are moved downwardldy toward the corresponding bottom plates 12*a* and 12*b* within the corresponding cylinders 5*a* and 5*b*. Therefore, the liquid previously sucked into the cylinder 5*a* or 5*b* is discharged into the corresponding discharging system (not shown) from the respective port 13*a* or 13*b* through the respective check valve 16*a* or 16*b* via the respective liquid outlet port 4*a* or 4*b*.

The pulse motor 10 is changed in its rotational angle only by the number of the electric input pulses per unit time. When the number of the electric input pulses per unit time is controlled, the pulse motor 10 can exactly be energized to rotate at a given speed. The pulse motor 10 may also be stopped or rotated promptly by intermittently controlling the electric input pulses. Therefore, the movement of the pistons 11*a* and 11*b* in the cylinders 5*a* and 5*b* can exactly be controlled by controlling the electric input pulses to the pulse motor 10, so that the displacement from the cylinders 5*a* and 5*b* can optionally be controlled even if they are very small.

As will be apparent from the foregoing, the variable displacement pump of the present invention comprises a cylinder member, a piston member slidably received within the cylinder member, a rack mounted on one of the members and extending parallel to the longitudinal axis of that member, a pulse motor including a pinion engaged by the rack, whereby movement of the piston member within the cylinder member can optionally and exactly be controlled by controlling electrical input pulses to the pulse motor. The cylinder or piston is formed with a port used to effect the suction and discharge of the liquid therein. Check valves are disposed between the port and a source of liquid and between the port and a liquid discharging system, so that the liquid discharged from the cylinder through the port will not be directed back to the source of liquid. Thus, very small displacement of the pump can exactly be attained by controlling the electric input pulses and can optionally be controlled in a numerical manner. Furthermore, the discharge of liquid can promptly be stopped to provide an intermittent discharge at a desired rate. In addition, the variable displacement pump may be reduced in size and weight. By increasing the number of cylinder-piston mechanisms, the pump may have a desired number of discharging systems.

I claim:

1. A variable displacement pump comprising, in combination:

(a) a cylinder member, (b) a piston member slideably received in said cylinder member, (c) said members having a common longitudinal axis, (d) a rack rigidly connected to one of said members and extending parallel to said longitudinal axis, (e) a pulse motor having an output shaft and with said motor being controllable to control the displacement of said pump, (f) a pinion fixedly disposed on said shaft and in engagement with said rack to move the latter, (g) one of said members having a single opening for alternate fluid entry into and discharge from said cylinder member, (h) a common fluid line connected to said opening, (i) said common line being connected to a first line portion for connection to an upstream fluid source, (j) said common line being connected to a second line portion disposed in parallel with said first line portion for connection to a downstream system, (k) first check valve means disposed in said first line portion for permitting fluid flow only in a direction from the fluid source and through said common line to said opening and cylinder member upon movement of one of said members in one direction in response to said pulse motor, (l) second check valve means disposed in said second line portion for permitting fluid flow only in a direction from said cylinder member and opening and through said common line toward said downstream system upon movement of said one of said members in a direction opposite to said one direction.

(m), said piston member extending from each end of said cylinder member, (n) connecting members attached to the respective ends of said piston member, (o) said rack having end portions attached to the respective connecting members to cause sliding movement of said piston member relative to said cylinder member, (p) and said connecting members forming means for joining the piston member of said variable displacement pump to the piston member of a second said pump so that the piston members of both said pumps move unidirectionally upon movement of said rack.

* * * * *